US010806206B1

(12) United States Patent
Ryan

(10) Patent No.: US 10,806,206 B1
(45) Date of Patent: Oct. 20, 2020

(54) VENTING SYSTEM FOR HATS

(71) Applicant: John P. Ryan, Long Valley, NJ (US)

(72) Inventor: John P. Ryan, Long Valley, NJ (US)

( * ) Notice: Subject to any disclaimer, the term of this patent is extended or adjusted under 35 U.S.C. 154(b) by 0 days.

(21) Appl. No.: 16/788,855

(22) Filed: Feb. 12, 2020

(51) Int. Cl.
*A42C 5/04* (2006.01)

(52) U.S. Cl.
CPC ..... *A42C 5/04* (2013.01)

(58) Field of Classification Search
CPC ..... A42B 1/008; A42B 1/08; A42B 3/281; A42B 3/28; A42B 3/003; B64G 6/00
USPC ..... 2/171.3
See application file for complete search history.

(56) References Cited

U.S. PATENT DOCUMENTS 1,955,986 A 4/1934 Tice
1,988,101 A 1/1935 Wittcoff
1,990,096 A 2/1935 Rothchild
1,997,708 A 4/1935 Uriwal
2,759,186 A * 8/1956 Dye ..... A42B 3/121 2/413
3,169,251 A * 2/1965 Humes, Jr. ..... A42C 5/04 2/171.03
3,348,239 A * 10/1967 Lamour ..... A42B 1/043 2/171.3
3,668,704 A * 6/1972 Conroy ..... A42B 3/122 2/413
3,780,382 A 12/1973 Boden
3,925,821 A 12/1975 Lewicki
RE29,452 E * 10/1977 Townsend, Jr. ..... A42C 5/04 2/209.7
4,101,981 A 7/1978 Boden
4,476,589 A 10/1984 Burgin
4,622,700 A 11/1986 Sundahl
5,365,607 A 11/1994 Benevento
5,495,622 A 3/1996 Kaufman
5,819,318 A * 10/1998 Tse ..... A42B 1/22 2/182.1
5,855,023 A 1/1999 Clingenpeel
(Continued)

FOREIGN PATENT DOCUMENTS

EP 2 555 644 1/2015
WO WO 2000/076334 12/2000

*Primary Examiner* — Timothy K Trieu
(74) *Attorney, Agent, or Firm* — Andrew W. Ludy

(57) ABSTRACT

A venting system for hats has a resilient, shock-absorbing headband inside the lower periphery of a hat dome. The headband has inner and outer annular bands spaced apart by a air passages. A plurality of arcuate septums are in contact with one another consecutively around a perimeter of the headband. Inwardly directed forces normal to the headband are converted into compressive forces on the septums directed along the headband perimeter. Forces on the head of the user are thereby reduced. A top vent with ports around a chamber extends upward from the dome. A cover across the top vent sheds water. The top vent is selectively movable upward into an open position to allow air flow through the headband air passage, the dome, the chamber, and out of the ports by convection. Ambient air will also flow in through the top vent ports and exit the ports on the opposite side. This will cause a lower than ambient air pressure to draw air out, cooling the dome. The top vent is selectively movable downward into a closed position to stop air flow, and retain heat inside the dome.

16 Claims, 7 Drawing Sheets

(56) References Cited

U.S. PATENT DOCUMENTS

| | | | | |
|---|---|---|---|---|
| 5,887,289 | A * | 3/1999 | Theoret | A42B 1/08 2/195.1 |
| 6,370,697 | B1 | 4/2002 | Held | |
| 7,010,814 | B2 * | 3/2006 | Benziger | A42B 1/08 2/171.2 |
| 7,673,350 | B2 * | 3/2010 | Mazzoccoli | A42B 1/08 2/411 |
| 8,516,617 | B1 | 8/2013 | Kazmierczak | |
| 9,839,251 | B2 * | 12/2017 | Pannikottu | A42B 3/064 |
| 2002/0017848 | A1 | 12/2002 | Lin | |
| 2004/0163162 | A1 * | 8/2004 | Benziger | A42B 1/08 2/411 |
| 2005/0013246 | A1 | 6/2005 | Lundgren | |
| 2006/0168712 | A1 * | 8/2006 | Mazzoccoli | A42B 1/08 2/411 |
| 2011/0001661 | A1 | 1/2011 | Rogers | |
| 2016/0015754 | A1 | 6/2016 | Lee | |
| 2017/0021551 | A1 | 8/2017 | Crunk | |

* cited by examiner

VENTING SYSTEM FOR HATS

TECHNICAL FIELD

This invention relates to hat vents, and more particularly, to an apparatus and method for circulating air through a hat in a controlled manner.

BACKGROUND

A variety of outdoor sports require covering the head with a hat to shade sunlight. These and other leisure and work activities conducted in hot weather while wearing a hat result in perspiration and discomfort. Body heat generated in the activity adds to solar heat trapped in the hat. In addition to being unpleasant, the heat can cause fatigue. Perspiration can run down into the eyes, obscuring vision. Stains can ruin the hat and clothing.

Hat vents are known, and have taken a variety of configurations in the past. Some hat vents in the prior art are as follows:

Held, U.S. Pat. No. 6,370,697; shows a vented headband, but no top outlet on the dome to allow air to escape upward.

Kaufman, U.S. Pat. No. 5,495,622; and Wittcoff, U.S. Pat. No. 1,988,101; each illustrates a vented headband, and several top outlets on the dome. The vents cannot be closed to control airflow.

Kazmierczak, U.S. Pat. No. 8,516,617; discloses a hat having a vented headband, but with the vents against the head, blocking air flow around the head. Upward outlet vents are thus rendered useless.

Lin, U.S. Publication No. 2002/0178487; Rogers, U.S. Publication No. US 2011/0016611; Tice, U.S. Pat. No. 1,955,986; and Rothchild, U.S. Pat. No. 1,990,096; each shows outlet vents in the dome, but no inlet vents around the headband. There is no convection flow. No impact protection is provided by the headband.

A common feature of the prior art is a headband 30, as shown in FIG. 1. The typical prior art headband has an inner band 36 and an outer band 38 spaced apart annularly inside the hat (not shown), forming an air passage 40. The headband 30 has a lower rim 32 and an upper rim 34. The prior art headband 30 has septums 42 spaced apart angularly between the inner and outer bands. The septums 42 are generally straight and disposed generally radially.

A significant problem in the prior art is in handling forces directed inwardly against the outer band 38. These inward forces 44 are shown in FIG. 2, and occur often in headwear such as helmets. On construction sites, helmets receive blows from material falling from a structure or carelessly handled. Bicycle and motorcycle riders can fall and strike their helmets on hard ground. Soldiers and military personnel can encounter explosive devices or artillery rounds nearby that deliver lethal shock forces to the helmet.

These inward forces 44 upon the outer band 38 cause compressive forces 50, or "hoop stress," in the outer band 38 as shown in FIG. 2. The forces are also directed along the septums 42 as compressive septum forces 46. This loads the inner band 36 with hoop stress compressive forces 52. The inwardly-directed forces 44 and 46 are imposed upon the head of the user, causing a reaction force 48 against the inner band 36. The inner 36 and outer 38 bands do little to absorb the forces delivered to the helmet.

Accordingly, there is a need to provide a venting system for hats that uses convection flow as a primary air mover.

There is a further need to provide a venting system for hats of the type described and that uses wind as a secondary air mover.

There is a yet further need to provide a venting system for hats of the type described and that allows the vents to be opened or closed to control airflow and temperature.

There is a still further need to provide a venting system for hats of the type described and wherein impact protection is provided by the headband, to minimize injury to the user.

There is another need to provide a venting system for hats of the type described and that will shed rainwater.

There is still another need to provide a venting system for hats of the type described and that is simple and robust in construction, for cost effective manufacture and long service life.

SUMMARY

In one aspect, a venting system is used in connection with a hat adapted for a head of a user. The hat has a dome with a lower periphery and a roof. The venting system comprises a headband disposed inside the dome and extending around the lower periphery of the dome. The headband extends between a lower rim and an upper rim. The headband has an inner band adapted for placement against the head of the user. The headband also has an outer band spaced apart from the inner band in an annular relationship.

The inner and outer bands are connected by a plurality of septums. Each septum has a generally arcuate cross-sectional geometry. The septums are in contact with one another consecutively around a perimeter of the headband. This will convert inwardly directed forces normal to the headband into compressive forces on the septums directed along the headband perimeter. Thus, the inwardly directed forces on the head of the user are reduced. The headband has a plurality of air passages disposed between the septums and in fluid communication with the dome. The headband is constructed from a resilient, shock-absorbing material.

A top vent is disposed inside the dome roof and is adapted for extending upward from the dome roof. The top vent has a peripheral wall extending from a lower edge to an upper edge. The peripheral wall encloses a chamber in fluid communication with the dome. The peripheral wall has a plurality of ports spaced apart around the peripheral wall and penetrating the peripheral wall.

A cover is attached to the peripheral wall upper edge. The cover extends across the peripheral wall so as to close the chamber. The cover projects radially outward beyond the peripheral wall to preclude water from entering the ports. Hence, air will flow through the headband air passage, through the dome, through the chamber, and out of the ports by convection. In addition, air will flow into the ports on a one side of the peripheral wall and exit the ports on an opposite side of the peripheral wall, causing air to be drawn out of the dome.

In another aspect, a venting system is used in connection with a hat adapted for a head of a user. The hat has a dome with a lower periphery and a roof. The venting system comprises a headband disposed inside the dome and extending around the lower periphery of the dome. The headband extends between a lower rim and an upper rim. The headband has an inner band adapted for placement against the head of the user. The headband has an outer band spaced apart from the inner band in an annular relationship.

The inner and outer bands are connected by a plurality of septums. The headband has a plurality of air passages disposed between the septums and in fluid communication with the dome. The headband is constructed from a resilient, shock-absorbing material.

A top vent is disposed inside the dome roof and adapted for extending upward from the dome roof. The top vent has a peripheral wall extending from a lower edge to an upper edge. The peripheral wall encloses a chamber in fluid communication with the dome. The peripheral wall has a plurality of ports spaced apart around the peripheral wall and penetrating the peripheral wall. The top vent has a flange projecting radially outward from the peripheral wall lower edge.

A cover is attached to the peripheral wall upper edge. The cover extends across the peripheral wall and serves to close the chamber. The cover projects radially outward beyond the peripheral wall to preclude water from entering the ports.

The top vent is selectively movable upward into an open position with the flange disposed adjacent an inside surface of the dome roof. This will allow air flow through the ports. Thus, in the open position, air will flow through the headband air passage, through the dome, through the chamber, and out of the ports by convection. In addition, ambient air will flow into the ports on one side of the peripheral wall and exit the ports on the opposite side of the peripheral wall. This will cause air to be drawn out of the dome, thereby cooling the dome.

Conversely, the top vent is selectively movable downward into a closed position with the cover disposed adjacent an outside surface of the dome roof. This will preclude air flow through the ports. Thus, in the closed position, air will not flow through the dome. In this manner, heat is retained inside the dome.

In yet another aspect, a method for venting a hat is disclosed. The hat is adapted for a head of a user, and has a dome with a lower periphery and a roof. The method comprises disposing a headband inside the dome, and extending the headband around the lower periphery of the dome. An outer band of the headband is spaced apart in annular relation from an inner band of the headband. The inner and outer bands are connected by a plurality of arcuate septums. The septums are in contact with one another consecutively around a perimeter of the headband.

Further steps include converting inwardly directed forces normal to the headband into compressive forces on the septums. The compressive forces are directed along the headband perimeter. In this manner, the inwardly directed forces on the head of the user are reduced.

Additional steps include disposing a plurality of air passages between the septums and in fluid communication with the dome. Ambient air passes through the plurality of air passages into the dome. A top vent is disposed on the dome roof in fluid communication with the dome. Air is passed from the dome through the top vent and out through ports. This causes air to flow through the dome and out of the top vent by convection, thereby cooling the dome.

These and other aspects, objectives, features, and advantages of the disclosed technologies will become apparent from the following detailed description of illustrative embodiments thereof, which is to be read in connection with the accompanying drawings.

Figure 1:
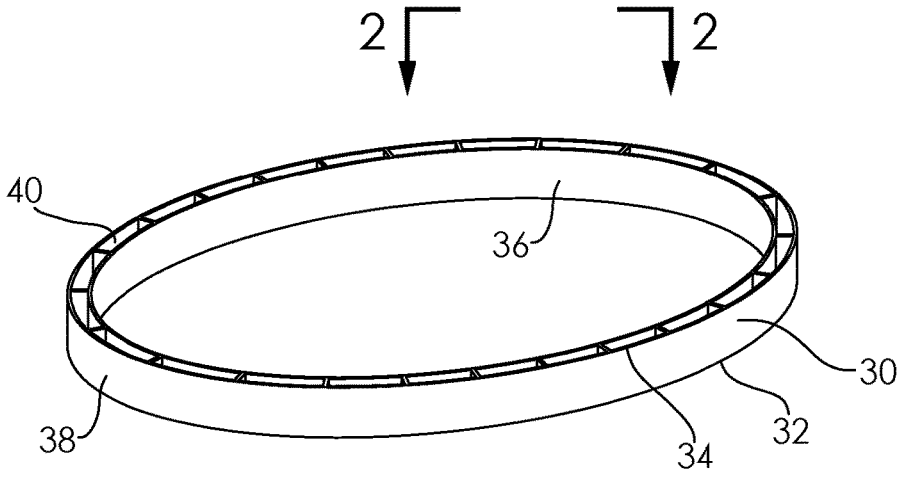
FIG. 1 PRIOR ART
FIG. 1 on sheet 1 is a perspective view of a prior-art hat vent, and showing the headband construction.
Figure 2:
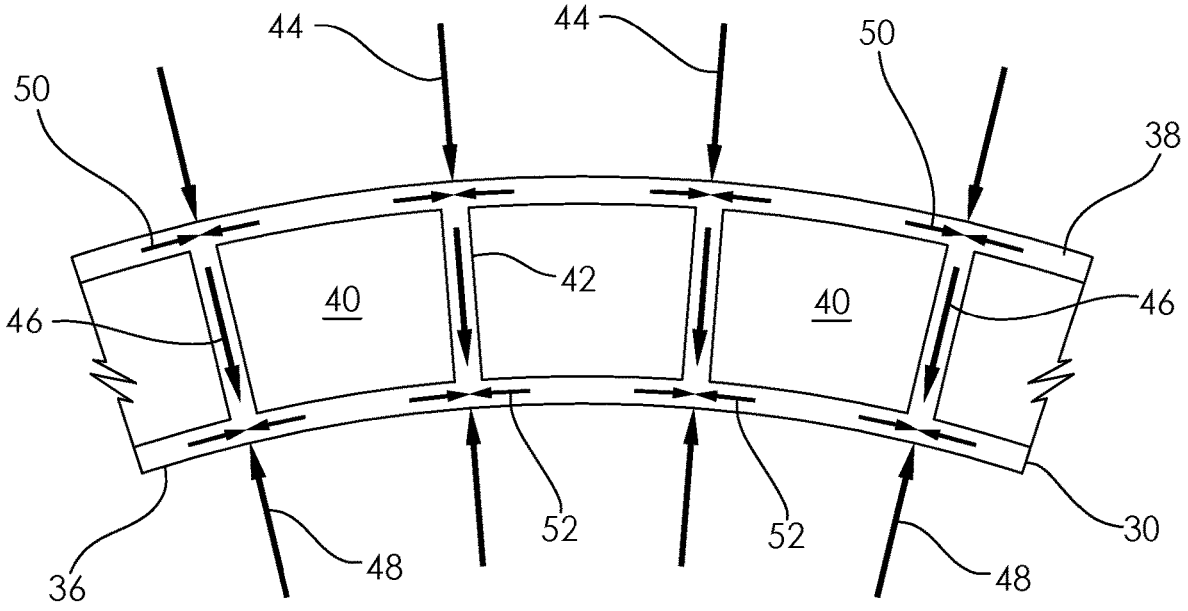
FIG. 2 PRIOR ART
FIG. 2 on sheet 1 is an enlarged, top plan detail view of the prior-art hat vent of FIG. 1, taken along lines 2-2 of FIG. 1.
Figure 3:
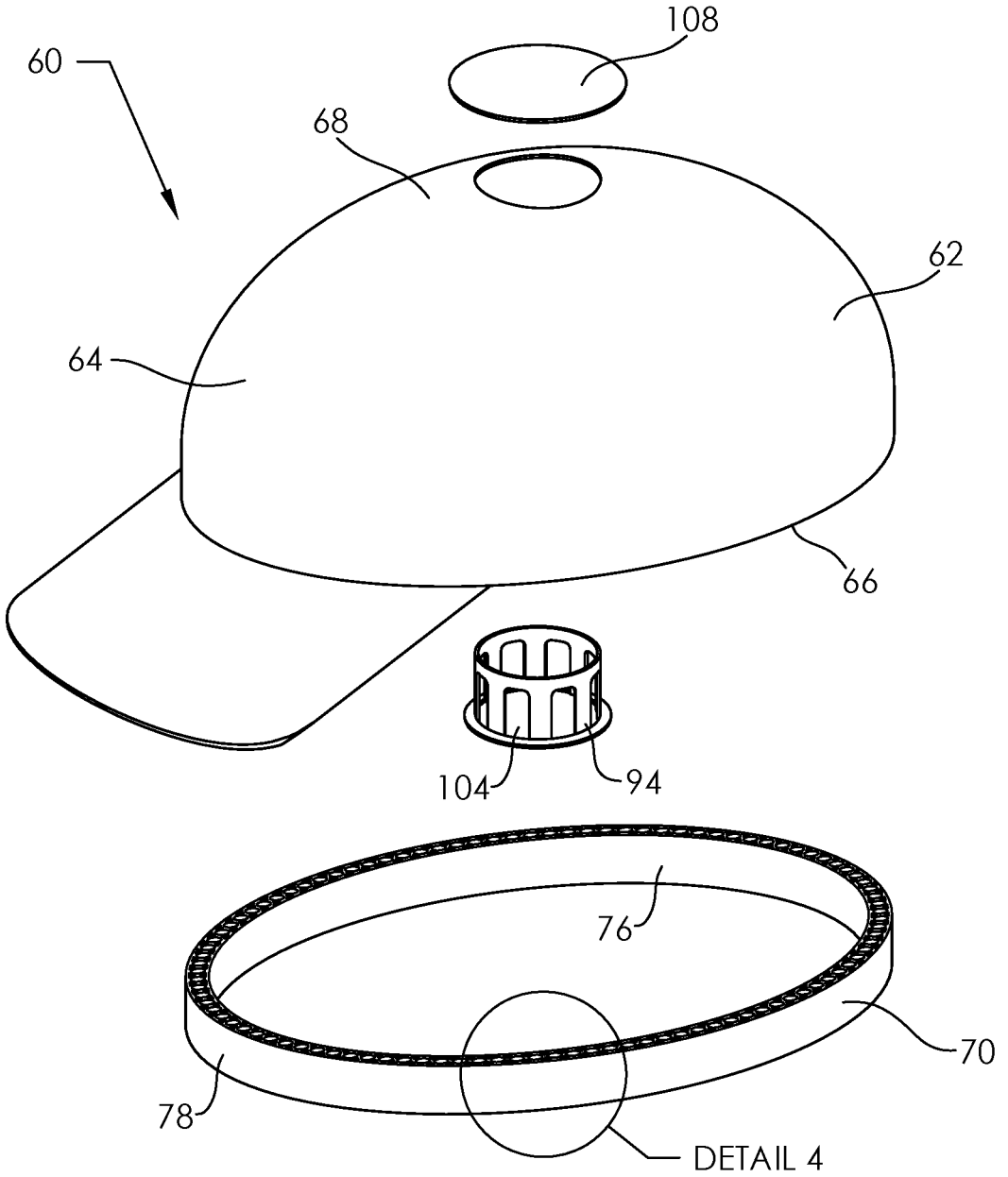
FIG. 3 on sheet 2 is a top perspective exploded view of an exemplary venting system for hats constructed in accordance with the invention.
Figure 4:
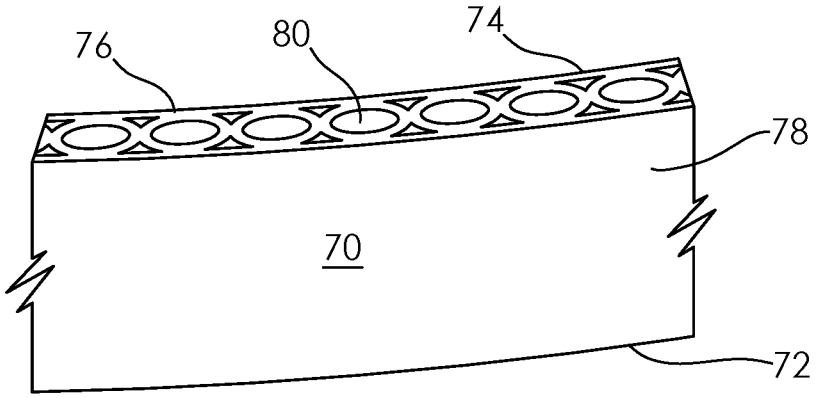
FIG. 4 on sheet 2 is an enlarged, side elevational detail view of the headband of the venting system for hats of FIG. 3, taken at detail 4 of FIG. 3.
Figure 5:
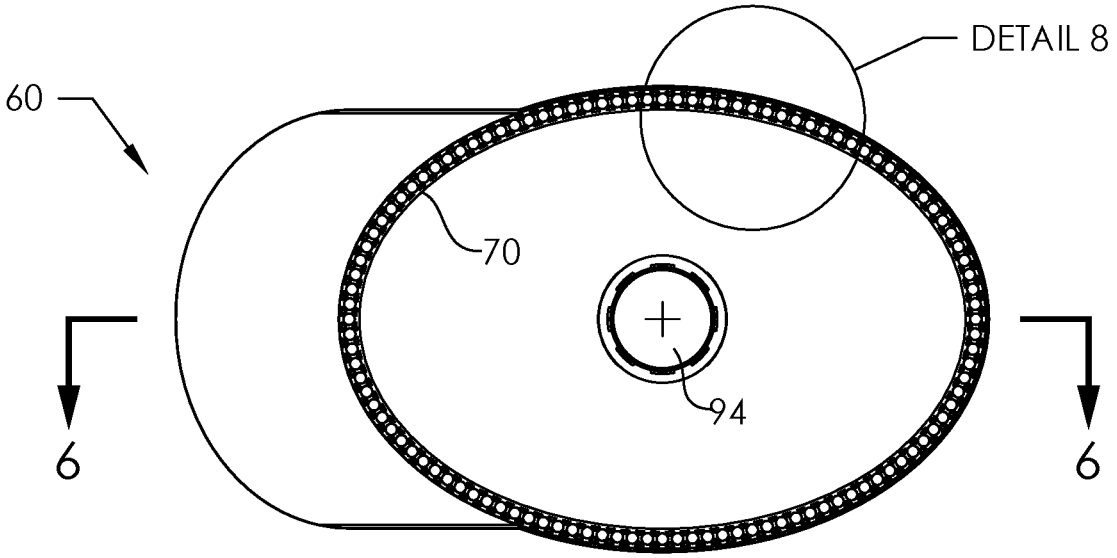
FIG. 5 on sheet 3 is a bottom plan view of the venting system for hats of FIG. 3.
Figure 6A:
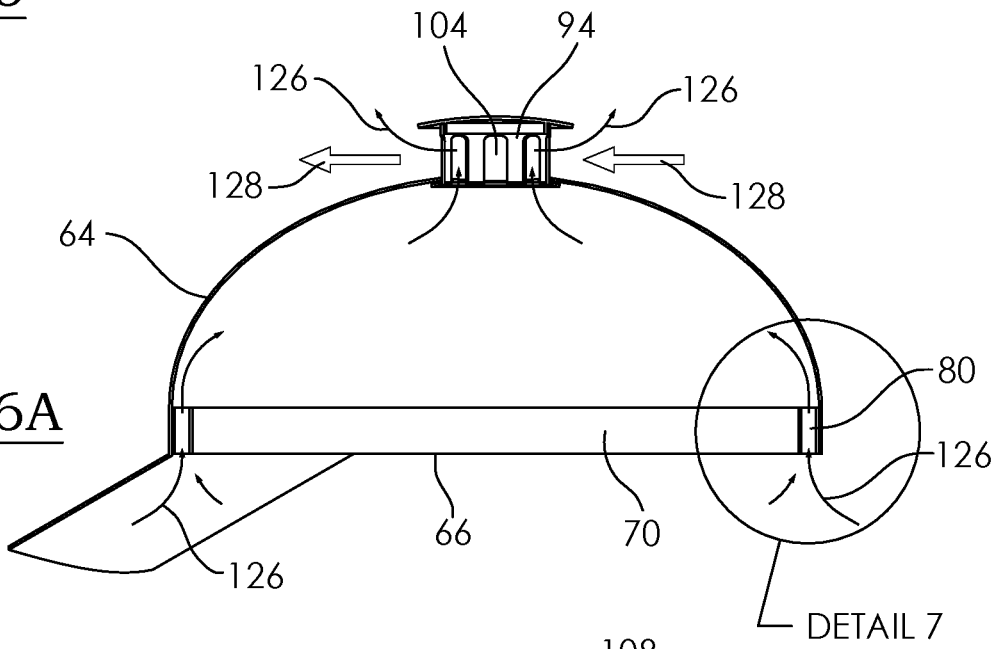
FIG. 6A on sheet 3 is a side elevational, cross-sectional view of the venting system for hats of FIG. 3, taken along lines 6-6 of FIG. 5, and showing the top vent open.
Figure 6B:
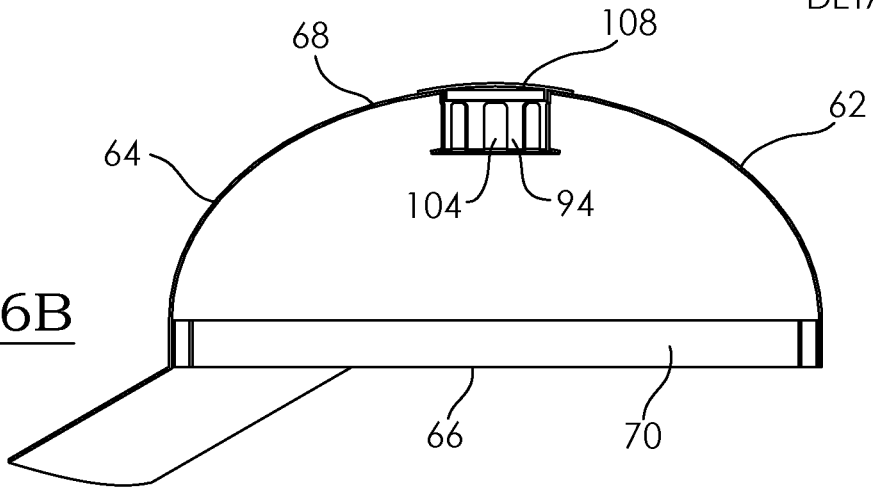
FIG. 6B on sheet 3 is a side elevational, cross-sectional view of the venting system for hats of FIG. 3, taken along lines 6-6 of FIG. 5, and showing the top vent closed.
Figure 7:
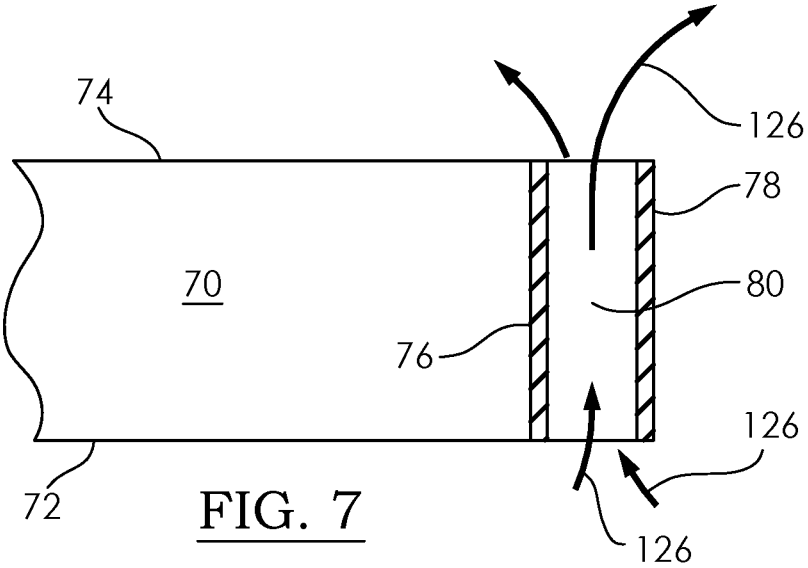
FIG. 7 on sheet 4 is an enlarged, side elevational, cross-sectional view of the headband of the venting system for hats of FIG. 3, taken at detail 7 of FIG. 6A, and showing the airflow.
Figure 8A:
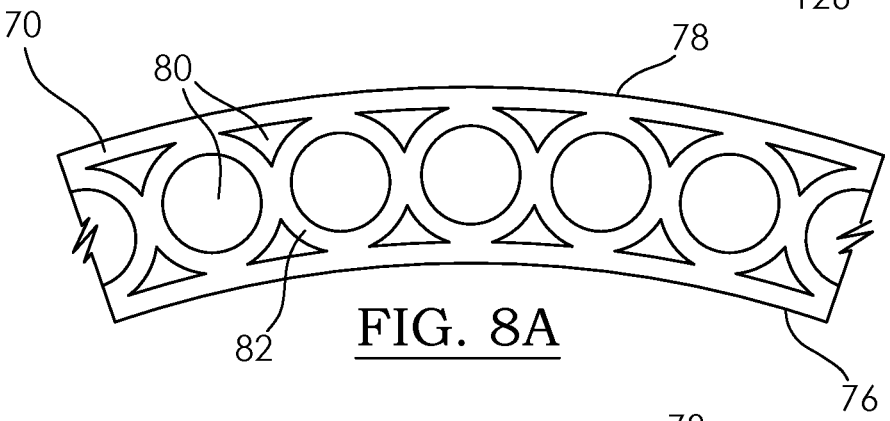
FIG. 8A on sheet 4 is an enlarged, top plan detail view of a headband for use with the venting system for hats of FIG. 3, taken at detail 8 of FIG. 5.
Figure 8B:
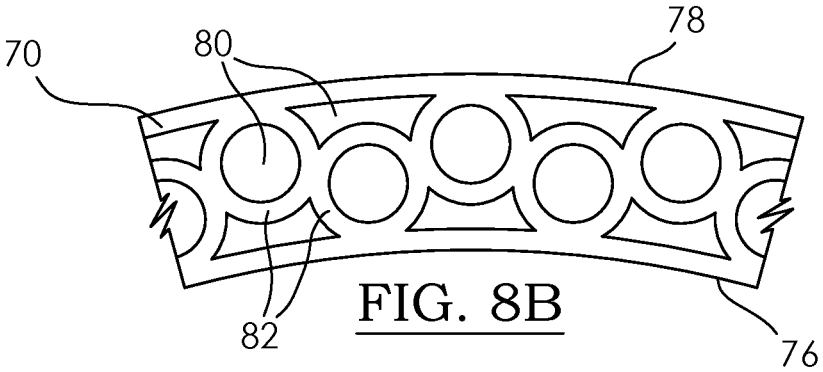
FIG. 8B on sheet 4 is an enlarged, top plan detail view of another headband for use with the venting system for hats of FIG. 3, taken at detail 8 of FIG. 5.
Figure 8C:
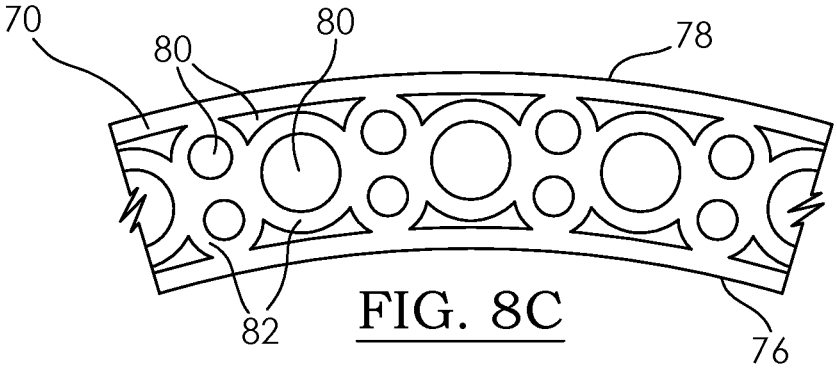
FIG. 8C on sheet 4 is an enlarged, top plan detail view of yet another headband for use with the venting system for hats of FIG. 3, taken at detail 8 of FIG. 5.
Figure 9:
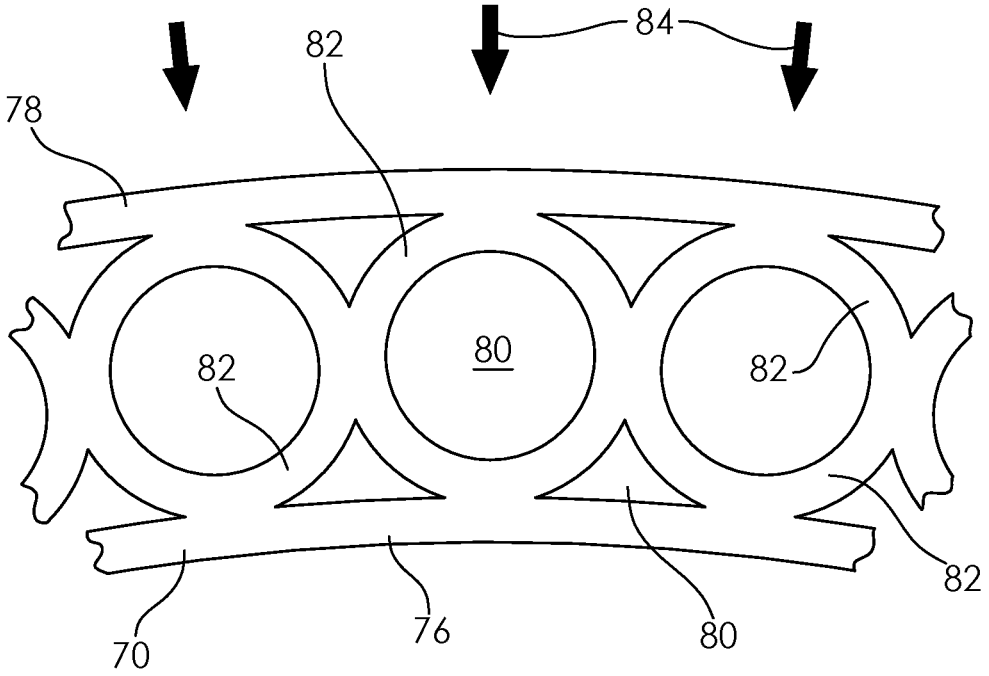
FIG. 9 on sheet 5 is an enlarged, top plan detail view of the headband of FIG. 8A, and showing external forces about to be applied to the headband.

It should be noted that the drawings herein are not to scale.

DETAILED DESCRIPTION

Describing now in further detail these exemplary embodiments with reference to the Figures as described above, a venting system 60 is for use in connection with a hat 62 having a dome 64. The dome 64 has a lower periphery 66 and a roof 68. The venting system 20 comprises a headband 70 disposed inside the dome 64 and extending around the lower periphery 66 of the dome. The headband 70 extends between a lower rim 72 and an upper rim 74. The headband 70 has an inner band 76 adapted for placement against a head of a user. The headband 70 has an outer band 78 disposed adjacent the inner band 76 in an annular relationship.

The headband 70 is constructed from a resilient, shock-absorbing material. The shock-absorbing capacity is required for uses such as bicycle and motorcycle helmets, in the event of an accident wherein the rider's head is struck. Another example is that of a soldier experiencing an explosive impact. Both the material and the geometry of the present embodiments, as described herein, are configured to absorb shock and recover resiliently.

Figure 10:
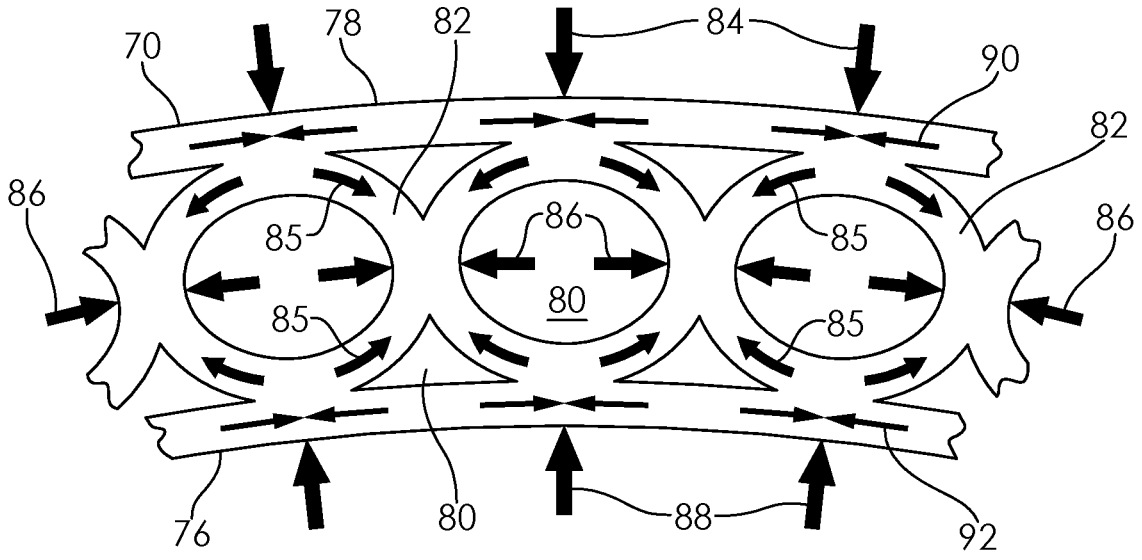
FIG. 10 on sheet 5 is an enlarged, top plan detail view of the headband of FIG. 8A, and showing external forces applied to the headband, and reactive forces throughout the structure.
Figure 11:
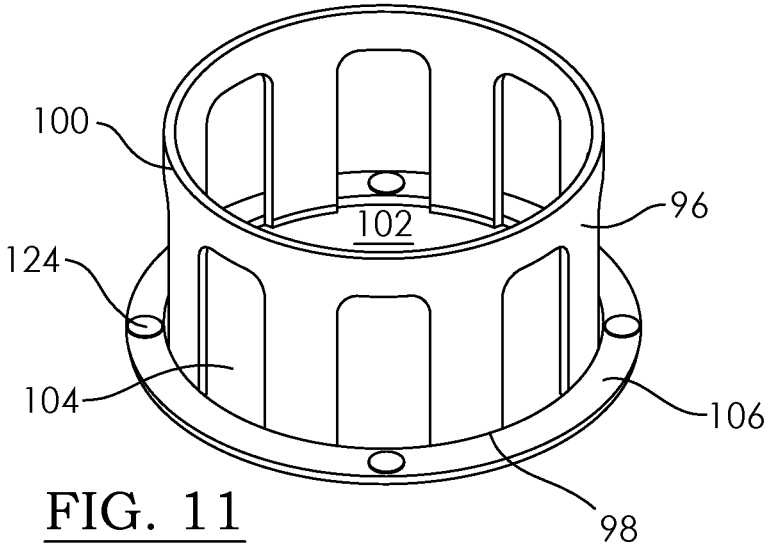
FIG. 11 on sheet 6 is a perspective view of a top vent for use with the venting system for hats of FIG. 3.
Figure 12:
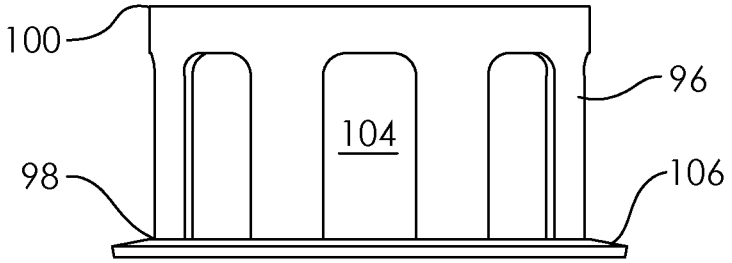
FIG. 12 on sheet 6 is a front elevational view of the top vent of FIG. 11.
Figure 13:
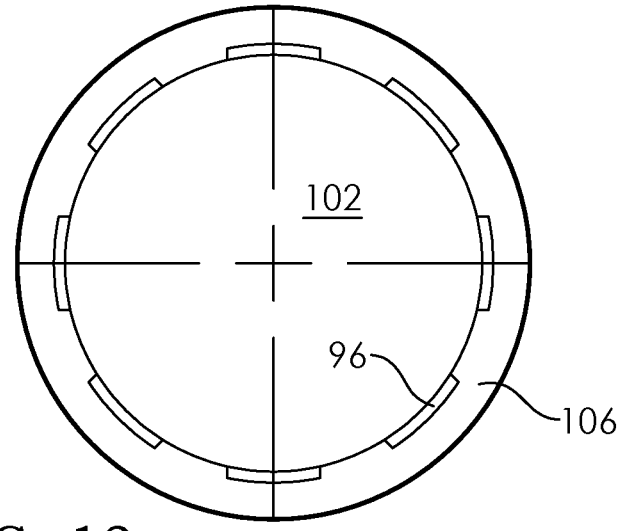
FIG. 13 on sheet 6 is a bottom plan view of the top vent of FIG. 11.
Figure 14:
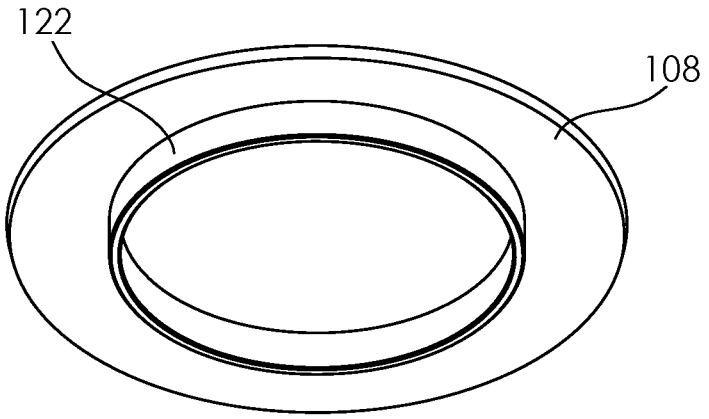
FIG. 14 on sheet 7 is a perspective view of a cover for use with the venting system for hats of FIG. 3.
Figure 15:
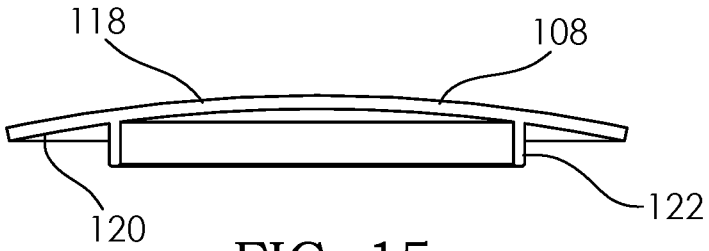
FIG. 15 on sheet 7 is a front elevational cross-sectional view of the cover of FIG. 14, taken along lines 15-15 of FIG. 16.
Figure 16:
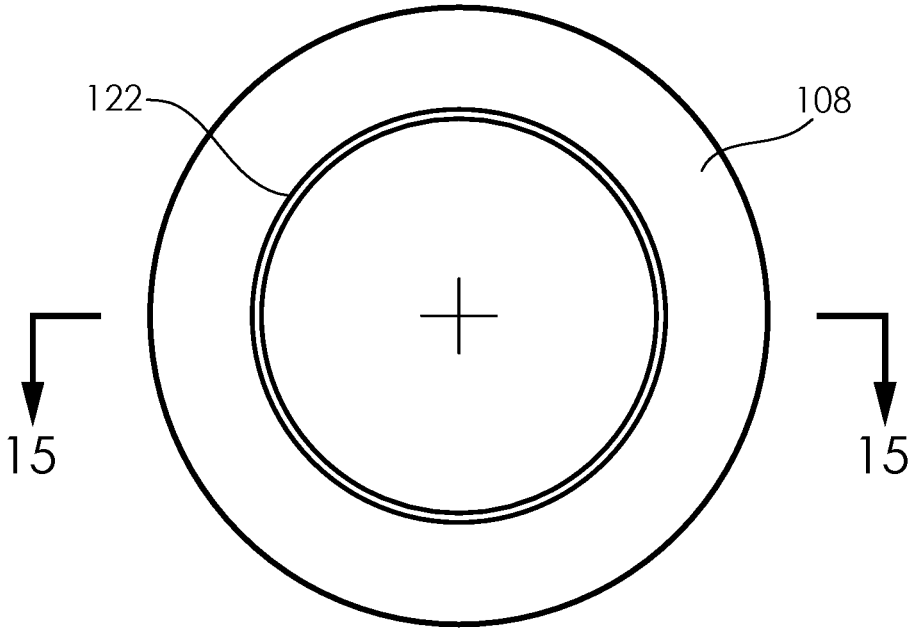
FIG. 16 on sheet 7 is a bottom plan view of the cover of FIG. 14.

The inner 76 and outer 78 bands are connected by a plurality of septums 82. The headband 70 has a plurality of air passages 80 disposed between the septums 82 and in fluid communication with the dome 64. Each septum 82 has a generally arcuate cross-sectional geometry. The septums 82 are in contact with one another consecutively around a perimeter of the headband 70. This will convert inwardly directed forces 84 normal to the headband 70 into compressive forces 85 on the septums directed along the arcuate septum structure 82. This compressive force 85 on the septums is resolved into compressive hoop stress 86 through the plurality of septums 82 and directed along the headband perimeter as shown by arrows 86 in FIG. 10. This structure allows externally imposed impact shock forces to be absorbed as compression in the septums. Thus, the forces transmitted to the head of the user are greatly diminished, thereby reducing injury to the user.

A top vent 94 is disposed inside the dome roof 68 and is adapted for extending upward from the dome roof 68. The top vent 94 has a peripheral wall 96 extending from a lower edge 98 to an upper edge 100. The peripheral wall 96 encloses a chamber 102 in fluid communication with the dome 64. The peripheral wall 96 has a plurality of ports 104 spaced apart around the peripheral wall 96 and penetrating the peripheral wall 96. The top vent 94 has a flange 106 projecting radially outward from the peripheral wall lower edge 98.

A cover 108 is attached to the peripheral wall upper edge 100. The cover 108 extends across the peripheral wall 96 so as to close the chamber 102. The cover 108 projects radially outward beyond the peripheral wall 96 to preclude water from entering the ports 104. The cover 108 has an upper surface 118, which is convex to shed water. The cover 108 has a lower surface 120, with a rim 122 extending around the lower surface 120 and downward therefrom. The rim 122 fits closely adjacent the peripheral wall upper edge 100, so as to seal the cover 108 to the top vent 94.

The top vent 94 is selectively movable upward into an open position 110 with the flange 106 disposed adjacent an inside surface 112 of the dome roof 68. This is to allow air flow through the ports 104. Thus, in the open position 110, air will flow through the headband air passage 80, through the dome 64, through the chamber 102, and out of the ports 104 by convection 126. The convection is driven by the difference in temperature between warm air inside the dome and cooler outside ambient air. The air inside the dome is warmed by body heat from the head. On sunny days, solar heat is added to the dome air. Hence, the dome 64 is cooled by convection 126.

In addition to convection 126, a pressure difference due to venturi effect also drives air flow through the hat 62. Outside, or ambient air 128 from wind flowing past the hat 62 drives air flow through the dome 64. Ambient air 128 will flow into the ports 104 on a one side of the peripheral wall 96. The ambient air 128 will exit the ports 104 on an opposite side of the peripheral wall 96. This will cause a lower than ambient air pressure to draw air out of the dome 64. Thus, the dome 64 is thereby cooled.

Conversely, the top vent 94 is selectively movable downward into a closed position 114 with the cover 108 disposed adjacent an outside surface 116 of the dome roof 68. This is to preclude air flow through the ports 104. Thus, in the closed position 114, air will not flow through the dome 64. In this manner, heat is retained inside the dome 64.

The top vent can include retaining means 124 for retaining the top vent 94 in either the open 110 or the closed 114 position. The retaining means 124 can take a variety of configurations; such as hook-and-loop fasteners, magnets, spring detents, and the like.

A method for venting a hat is disclosed. The hat 62 is adapted for a head of a user, and has a dome 64 with a lower periphery 66 and a roof 68. The method comprises disposing a headband 70 inside the dome 64, and extending the headband 70 around the lower periphery 66 of the dome 64. An outer band 78 of the headband 70 is spaced apart in annular relation from an inner band 76 of the headband 70. The inner 76 and outer 78 bands are connected by a plurality of arcuate septums 82. The septums 82 are in contact with one another consecutively around a perimeter of the headband 70.

Further steps include converting inwardly directed forces 84 normal to the headband 70 into compressive forces 85 on the septum structure and compressive hoop stress forces 86 on the septums. The compressive forces 86 are directed along the headband perimeter. The resilient septum material absorbs shock forces in compression along the headband perimeter. In this manner, the inwardly directed forces 84 on the head of the user are reduced, as well as reactive forces 88 on the head of the user.

Yet further steps include disposing a plurality of air passages 80 between the septums 82 and in fluid communication with the dome 64. Ambient air 128 passes through the plurality of air passages 80 into the dome 64. A top vent 94 is disposed on the dome roof 68 in fluid communication with the dome 64. Air is passed from the dome 64 through the top vent 94 and out through ports 104. This causes air to flow through the dome 64 and out of the top vent 94 by convection 126, thereby cooling the dome 64.

Still further steps include passing ambient air 128 into the ports 104 on an upwind side of the top vent 94 and out through ports 104 on an opposite side of the top vent 94. This causes a pressure reduction below ambient pressure in the top vent 94. Air is caused to flow through the dome 64 and out of the top vent 94 by pressure reduction below ambient pressure in the top vent 94, thereby cooling the dome 64.

Additional steps are precluding water from entering the ports 104 by attaching a cover 108 to the top vent 94 and projecting the cover 108 radially outward of the ports 104.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The embodiments of the invention in which an exclusive property or privilege is claimed are defined as follows:

1. A vented hat, the hat being adapted for a head of a user, the vented hat comprising:

a dome with a lower periphery and a roof;

a headband disposed inside the dome and extending around the lower periphery thereof, the headband extending between a lower rim and an upper rim, the headband having an inner band adapted for placement against the head of the user, the headband having an outer band spaced apart from the inner band in annular relation, the inner and outer bands being connected by a plurality of septums, each septum having an arcuate transverse cross-section between the inner and outer bands, the arcuate cross-section extending upward between the lower rim and the upper rim, each septum having an elongated air passage therethrough extending upward from adjacent the lower rim to adjacent the upper rim, each air passage being open at each end and in fluid communication with the dome, so as to allow upward airflow through the septums, the septums being in contact with one another consecutively around a perimeter of the headband, so as to convert inwardly directed forces normal to the headband into compressive forces on the septums directed along the headband perimeter, thereby reducing the inwardly directed forces on the head of the user, the headband being constructed from a resilient, shock-absorbing material;

a top vent disposed inside the dome roof and adapted for extending upward therefrom, the top vent having a peripheral wall extending from a lower edge to an upper edge, the peripheral wall enclosing a chamber in fluid communication with the dome, the peripheral wall having a plurality of ports spaced apart around the peripheral wall and penetrating the peripheral wall; and a cover attached to the peripheral wall upper edge, the cover extending across the peripheral wall so as to close the chamber, the cover projecting radially outward beyond the peripheral wall to preclude water from entering the ports; wherein air will flow through the headband air passage, through the dome, through the chamber, and out of the ports by convection; and air will flow into the ports on a one side of the peripheral wall and exit the ports on an opposite side of the peripheral wall, causing air to be drawn out of the dome.

2. The vented hat of claim 1, wherein:

the top vent further comprises a flange projecting radially outward from the peripheral wall lower edge; and wherein the top vent is selectively movable upward into an open position with the flange disposed adjacent an inside surface of the dome roof to allow air flow through the ports, so that in the open position, air will flow through the headband air passage, through the dome, through the chamber, and out of the ports by convection, and ambient air will flow into the ports on a one side of the peripheral wall and exit the ports on an opposite side of the peripheral wall, causing a lower than ambient air pressure to draw air out of the dome, thereby cooling the dome; and the top vent is selectively movable downward into a closed position with the cover disposed adjacent an outside surface of the dome roof to preclude air flow through the ports, so that in the closed position air will not flow through the dome, thereby retaining heat inside the dome.

3. The vented hat of claim 2, wherein the top vent further comprises retaining means for retaining the top vent in the open and closed position, the retaining means being selected from the group consisting of:

hook-and-loop fasteners;

magnets; and spring detents.

4. The vented hat of claim 1, wherein the cover further comprises:

an upper surface, the upper surface being convex to shed water;

a lower surface; and a rim extending around the lower surface and downward therefrom, the rim being adapted to fit closely adjacent the peripheral wall upper edge, so as to seal the cover to the top vent.

5. A vented hat, the hat being adapted for a head of a user, the vented hat comprising:

a dome with a lower periphery and a roof;

a headband disposed inside the dome and extending around the lower periphery thereof, the headband extending between a lower rim and an upper rim, the headband having an inner band adapted for placement against the head of the user, the headband having an outer band spaced apart from the inner band in annular relation, the inner and outer bands being connected by a plurality of septums, each septum having an arcuate transverse cross-section between the inner and outer bands, the arcuate cross-section extending upward between the lower rim and the upper rim, each septum having an elongated air passage therethrough extending upward from adjacent the lower rim to adjacent the upper rim, the headband having a plurality of air passages disposed between the septums and in fluid communication with the dome, the headband being constructed from a resilient, shock-absorbing material;

a top vent disposed inside the dome roof and adapted for extending upward therefrom, the top vent having a peripheral wall extending from a lower edge to an upper edge, the peripheral wall enclosing a chamber in fluid communication with the dome, the peripheral wall having a plurality of ports spaced apart around the peripheral wall and penetrating the peripheral wall, the top vent having a flange projecting radially outward from the peripheral wall lower edge; and a cover attached to the peripheral wall upper edge, the cover extending across the peripheral wall so as to close the chamber, the cover projecting radially outward beyond the peripheral wall to preclude water from entering the ports; wherein the top vent is selectively movable upward into an open position with the flange disposed adjacent an inside surface of the dome roof to allow air flow through the ports, so that in the open position, air will flow through the headband air passage, through the dome, through the chamber, and out of the ports by convection, and ambient air will flow into the ports on a one side of the peripheral wall and exit the ports on an opposite side of the peripheral wall, causing air to be drawn out of the dome, thereby cooling the dome; and the top vent is selectively movable downward into a closed position with the cover disposed adjacent an outside surface of the dome roof to preclude air flow through the ports, so that in the closed position air will not flow through the dome, thereby retaining heat inside the dome.

6. The vented hat of claim 5, wherein the plurality of septums further comprises:

each air passage being open at each end and in fluid communication with the dome, so as to allow upward airflow through the septums; and the septums being in contact with one another consecutively around a perimeter of the headband, so as to convert inwardly directed forces normal to the headband into compressive forces on the septums directed along the headband perimeter, thereby reducing the inwardly directed forces on the head of the user.

7. The vented hat of claim 5, wherein the top vent further comprises retaining means for retaining the top vent in the open and closed position, the retaining means being selected from the group consisting of:

hook-and-loop fasteners;

magnets; and spring detents.

8. The vented hat of claim 5, wherein the cover further comprises:

an upper surface, the upper surface being convex to shed water;

a lower surface; and a rim extending around the lower surface and downward therefrom, the rim being adapted to fit closely adjacent the peripheral wall upper edge, so as to seal the cover to the top vent.

9. A method for venting a hat adapted for a head of a user, the hat having a dome with a lower periphery and a roof, the method comprising:

disposing a headband inside the dome, and extending the headband around the lower periphery of the dome;

spacing an outer band of the headband apart in annular relation from an inner band of the headband;

connecting the inner and outer bands by a plurality of septums, each septum having a generally arcuate transverse cross-section between the inner and outer bands;

extending the arcuate cross-sections upward between the lower rim and the upper rim;

extending a plurality of air passages through the septums upward from adjacent the lower rim to adjacent the upper rim, opening the air passages at each end, and communicating the air passages fluidly with the dome;

contacting the septums consecutively around a perimeter of the headband;

passing ambient air upward through the plurality of air passages into the dome;

disposing a top vent on the dome roof and communicating the top vent fluidly with the dome;

passing air from the dome through the top vent and out through ports; and causing air to flow through the dome and out of the top vent by convection, thereby cooling the dome.

10. The method of claim 9, further comprising the step of constructing the headband being from a resilient, shock-absorbing material.

11. The method of claim 10, further comprising the step of absorbing shock from an outside impact, thereby precluding personal injury.

12. The method of claim 9, further comprising the steps of:

passing ambient air into the ports on an upwind side of the top vent and out through ports on an opposite side of the top vent, thereby causing a pressure reduction below ambient pressure in the top vent; and causing air to flow through the dome and out of the top vent by pressure reduction below ambient pressure in the top vent, thereby cooling the dome.

13. The method of claim 12, further comprising the steps of:

selectively moving the top vent upward into an open position for allowing air flow through the ports; and selectively moving the top vent downward into a closed position for precluding air flow through the ports, thereby retaining heat in the dome.

14. The method of claim 13, further comprising the steps of retaining the top vent in the open and closed position, using retaining means selected from the group consisting of:

hook-and-loop fasteners;

magnets; and spring detents.

15. The method of claim 9, further comprising the step of precluding water from entering the ports by attaching a cover to the top vent and projecting the cover radially outward of the ports.

16. The method of claim 9, wherein the hat is subjected to external forces applied to the headband, the method further comprising the steps of:

converting the inwardly directed forces into compressive forces on the septums and directing the compressive forces along the headband perimeter; and absorbing the forces by resiliently compressing the septums; thereby reducing the inwardly directed forces on the head of the user.

* * * * *